United States Patent [19]

Smadja

[11] 4,256,734

[45] Mar. 17, 1981

[54] METHOD FOR MAKING ROAD SURFACE COATINGS

[76] Inventor: Rene Smadja, 1, E. rue di la Pommeray, 76 Notre Dame de Gravenchon, France

[21] Appl. No.: 779,386

[22] Filed: Mar. 21, 1977

[30] Foreign Application Priority Data

Nov. 4, 1976 [FR] France ..... 76 33304

[51] Int. Cl.[3] ..... B05D 5/10; E01C 5/12

[52] U.S. Cl. ..... 427/139; 106/122; 106/273 R; 106/278; 404/75

[58] Field of Search ..... 427/138, 139, 180, 194, 427/202, 403, 407, 359; 428/489; 106/122, 273, 279, 278; 404/72, 75, 27

[56] References Cited

U.S. PATENT DOCUMENTS

| | | | |
|---|---|---|---|
| 984,801 | 2/1911 | Davis | 427/139 |
| 2,876,126 | 3/1959 | Sommer | 106/122 |
| 2,917,395 | 12/1959 | Csanyi | 106/122 |
| 3,103,860 | 9/1963 | Piquette | 427/139 |
| 3,245,329 | 4/1966 | Nagm et al. | 427/139 |
| 3,272,098 | 9/1966 | Buchholtz et al. | 427/136 |
| 3,353,978 | 11/1967 | Danie | 106/275 |
| 3,468,822 | 9/1969 | Wismer et al. | 106/273 |
| 3,650,791 | 3/1972 | Fauber | 106/279 |
| 3,839,518 | 10/1974 | Rubens et al. | 404/27 |
| 3,932,331 | 1/1976 | Doi et al. | 427/138 |
| 3,965,281 | 6/1976 | Takase et al. | 427/194 |

*Primary Examiner*—Ronald H. Smith
*Assistant Examiner*—Sadie L. Childs
*Attorney, Agent, or Firm*—Charles A. Huggett; Charles J. Speciale

[57] ABSTRACT

A method is provided for making road surface coatings by depositing a layer of chippings on a hydrocarbon binder in the form of a foam and wherein the thickness of the foam is substantially equal to the maximum dimension of the chippings and thereafter compacting the resulting product mixture.

4 Claims, No Drawings

METHOD FOR MAKING ROAD SURFACE COATINGS

BACKGROUND OF THE INVENTION

1. Field of the Invention

This invention relates to a method for road surfacing wherein a hydrocarbon binder in the form of a foam is employed.

2. Description of the Prior Art

Road surface coatings with which the present invention is concerned are thin coatings which generally have no reinforcing effect on the roadways but which form idling surfaces either on roadways which are already coated and which require maintenance or on new roadways on which they form the surface layer.

It has heretofore been known to provide such coatings on the roadway to be surfaced with a layer of bituminous binder, on which is deposited a specified quantity of chippings (composed of suitably graded inorganic particles). If desired, a number of superimposed layers of such surfacings may be deposited. The binder layer is conventionally employed in quantities of from 0.75 to 2.50 kg. of binder per square meter, substantially corresponding to binder thickness of 0.75 to 2.50 mm. Graded products are employed in the case of chippings characterized by a particle size such that they pass through a screen of mesh dimension D (mm.) and do not pass through a screen of mesh dimension d (mm.) with d/D generally being 4/6, 6/10 or 10/14.

In spite of the precise standards and special precautions taken for deposition of the above road surfaces, the technique employed has encountered difficulty in application with consequent frequent failures. The latter have lead to serious consequences for road users since inadequate adhesion of the chippings by the binder causes the chippings to become unstuck and to be projected by the traffic leading to dangerous driving conditions which in turn are the cause of damage to vehicles using the roadway including broken windshields and the like. This problem of user safety is rendered more significant by the trend towards increased use of such surfacings on high speed roadways, due to the exceptional roughness of these surfaces.

SUMMARY OF THE INVENTION

The present invention is directed to a new technique for road surfacing in which the binder is applied in the form of foam. More particularly, the invention is concerned with a method for making surface coatings with the aid of a hydrocarbon binder and chippings, wherein the hydrocarbon binder is used in the form of a foam with controlled stability time.

The invention also relates, as a new product, to a surface coating of novel structure in which the individual elements of adjacent chippings are bonded to one another by a layer of hydrocarbon binder located at the lateral walls.

The binder employed in accordance with the present invention may be one of the materials used in the present surfacing techniques, i.e. tars, tar compounds, asphalts, asphalts containing various additives such as plastics, and mixtures of these various materials. These binders may either be in the pure state, or mixed with coal-tar oils or solvents of petroleum orgin. This binder may be defined for example by its STV viscosity for the products of low viscosity (such a viscosity 10mm at 25° C. may be between 0 and 5000 seconds) or by its softening point for the products of high viscosity (this point of softening measured according to the Ball Ring method may be between 10° and 200° C.).

The binder is used in the form of a foam of "controlled stability". The latter expression implies that the foam which is applied must have a stability which lasts long enough to be able to impregnate the side walls of the chippings, but must then give, fairly quickly, a non-foamy binder which solidifies. Said foam may have, for example, while it is being applied, an apparent density of between 25 and 200 gram/liter.

DESCRIPTION OF SPECIFIC EMBODIMENTS

The method of the invention includes the following operations:

(1) application on the surface to be coated (after possible known preparation of said surface), of a hydrocarbon binder in the form of a foam having a high rate of expansion;

(2) spreading on said foam, while it is still in a suitably expanded state, of at least one layer of suitably graded chippings;

(3) compacting of the coating.

The first operational step involves application onto the surface to be coated, of a hydrocarbon binder in the form of a foam with a high rate of expansion. The high rate of expansion signifies that, at the moment when the binder foam is applied, or very shortly thereafter, the rate of expansion thereof is maximum. This rate of expansion, which will progressively reduce in the course of time, is chosen to remain for a sufficient interval while at least one layer of chippings is added.

The second operational step involves spreading on the hydrocarbon binder which is still in a suitable foamy state, at least one layer of chippings. It is important in the present invention to observe a certain relationship between the quantity of hydrocarbon binder used and the area to be coated, the rate of expansion of this binder and the average dimensions of the chippings, when such chippings are spread out on the foam. In fact, the foam of hydrocarbon binder must coat the lateral surfaces of the chippings and be deposited thereon to a sufficient height for said binder to make bonds between the lateral surfaces of the chippings. In this way, for example, if a chipping of one average granulometry is employed, it will be necessary that at the moment of spreading of said chippings, the height of the layer of foam must be at least half or two thirds of the average dimensions of said chippings. If it is desired to use two types of chippings, one of fairly large granulometry and the other of small granulometry, (the grains of the latter being inserted between the grains of the chippings of larger granulometry), the height of the layer of foam at the moment of spreading of the chipping of large dimensions (which chipping is always spread before the aggregate of small granulometry) will have to be the same size as the average dimensions of the chipping of smaller dimensions which will be spread subsequently. To be able to realize this condition, it will obviously be desirable to know the speed of subsidence of the binder foam and to have parameters which make it possible to act on this speed or on the maximum rate of expansion at the beginning of the procedure.

In the proposed method, the chippings are distributed directly into the asphalt foam, and are wetted by the binder on all surfaces except those uppermost, which permits the chippings not only to adhere to the support with their lower surfaces but also to bind to each other by their lateral surfaces. In this case, by employing the technique of double surfacing (an initial spreading of coarse-grade 10/14 mm chippings, followed by a layer of small 2/6 mm chippings), it is possible to obtain a surface layer formed of contiguous chippings, bonded to one another and to their support, thereby offering exceptional cohesion. This surface layer has been found capable of resisting tangential traffic stresses with improved effectiveness.

In addition to the inter-chipping cohesion provided by this procedure, it also offers the following advantages over conventional techniques:

(a) Relative to fluxed binders or fluidized binders: Surfacings laid down with these types of binder have the inconvenience of a certain fragility during the first two weeks of exposure to traffic, when evaporation of the solvents contained in the binders takes place. This inconvenience does not exist with the proposed procedure, which utilizes a binder without fluxing agent, or only very slightly fluxed.

(b) Relative to emulsions: Emulsions employed for surfacing contain approximately 40 percent water; upon breakdown of the emulsion, this water serves to diminish the cohesive force between binder and chippings, so that such surfacings are very fragile during the first hours of traffic.

In both cases, the initial fragility of the surfacing necessitates the utilization of a large excess amount of chippings which must be subsequently removed, while surfacing laid by the proposed technique shows no initial fragility. Furthermore, the cohesive forces joining the chippings to each other and to their support are provided by pure or very slightly fluxed binder, permitting them to achieve a very high level as soon as the binder has cooled. This advantage allows traffic to open as soon as the binder cools, without risk of chippings becoming detached.

It has been indicated hereinabove that, in order suitably to carry out the invention, it was desirable to know the characteristics of the foams of the hydrocarbon binder and to control their rates of expansion and/or speed of subsidence.

A foam based on hydrocarbon binder may be manufactured by employing one of the following procedures:

(1) injection of a gas in a binder taken to a temperature higher than the temperature of condensation of the gas;

(2) vaporization of a liquid fluid in a binder taken to a sufficient temperature to insure this vaporization.

One technique of making such a foam is, for example, described in French Pat. No. 2,077,238, as far as asphalts or bitumens are concerned.

The gas/binder or liquid/binder mixtures may be made in a chamber containing Rashchig rings or one or more metal grids. When the fluid is injected in the liquid state, it is possible to place the mixing chamber under pressure so as to obtain a mixture in liquid fluid-binder phase. In this case, the fluid will evaporate by expansion on leaving the mixing chamber and will lead to an even more expanded foam.

The manufacture of foam may therefore be obtained continuously by injection of suitable fluid (gaseous or liquid) in a line conveying binder taken to a sufficient temperature; by passing through a mixing chamber, the two products are intimately combined, forming a foam which may than be pulverized.

The duration of stability of heretofore obtained foams was generally insufficient for them to be used for surfacing. In order to be able to carry out this technique, the foams of hydrocarbon binder must still be maintained in expanded form for the order of 6,30 to 40 seconds after said foam has been applied.

To effect the partial stabilization of the hydrocarbon binder foams, various techniques may be used (1) Use of fluorinated hydrocarbons as the expansion agent.

Thus, from 1 to 15 percent by weight of $CCl_3F$ (i.e. Freon II) or equivalent gas with respect to a road asphalt may be used as the expansion agent.

(2) Improvement of the binder-water affinity for the foams using water as expansion agent.

The binder-water affinity depends on the interfacial tension existing between these two products. The improvement of this affinity may be effected by means of any surface-active agent of the hydrophilic-lipophilic type that may reduce the interfacial water-asphalt tension. The products of anionic, cationic or non-ionic type used currently for making asphalt emulsions give very satisfactory results. It is to be noted that the surface-active agents for inverse emulsions are particularly recommended; by way of example, mention may be made of the fatty amine hydrochlorides, fatty acid salts, quaternary ammonium salts, ethylene poly-oxides, amidoamines, imidazoline hydrochlorides and fluorinated compounds.

It is also possible to form the surface-active agent in situ at the moment of evaporation of the water; for example, by reaction of an asphalt, to which stearic, oleic or naphthenic acid has been added, with water containing soda or potash, or by reaction of an asphalt to which alkylpropylenediamine is added, with water containing hydrochloric acid. By reason of the supplementary improvement that they make concerning the adhesiveness of the asphalts on the siliceous materials, the surface-active agents based on polyamine will be used in preference to the others.

(3) Increase of the rigidity of the binder film.

This may be effected in two different manners:

(a) by injection of aqueous emulsions of polymers with high softening points; the asphalt foam forming by evaporation of the aqueous phase of the emulsion, the polymer is deposited on the films of asphalt and rigidifies them. The polymers in emulsions may be styrene butadienes, vinyl acetates, acrylic or maleic esters.

(b) by polymerization of a monomer within the asphalt at the moment of the formation of the foam by injection of water; further to the high temperature ($>100°$ C.) of the asphalt, the polymerization reaction is very rapid and the polymer thus formed in situ rigidifies the films of asphalt.

The polymerization reaction may be that of a polyalcohol, polyether or polyester on a diisocyanate which forms a polyurethane (the simple reaction of water on a diisocyanate which brings about the formation of polyureas with emission of $CO_2$ may also be used). The injection of water also allows the emission of $CO_2$ and the formation of rigid polyurethane foam. This polyurethane foam which is mixed with the asphalt foam leads to a very stable expanded material if the reaction products are present in a sufficient quantity. The diisocyanate is mixed with the asphalt taken to 120° C.; the polyether is mixed with injection water and introduced at the same time in the asphalt; part of the water serves to form the asphalt foam by evaporation, another part reacts with the diisocyanate and the polyether to form the polyurethane foam by emission of $CO_2$.

In the particular case of the increase in the rigidity of the film of the binder being effected by the formation, inside the binder and during the foaming of said latter, of a polyurethane foam, it has been ascertained that:

the quantity of polyisocyanate which may used had to be included between 0.2 and 20 percent of the weight of the mixture (polyisocyanate-binder), it being understood that the polyisocyanate is measured by weight of reactive isocyanate functions contained in said polyisocyanate.

the quantity of polyol (of the polyester or polyether type) expressed by weight of reactive hydroxyl groups, should be between 0 and 3 times the quantity (by weight) of isocyanate groups.

the quantity of water which may be used is between 0 and 3 times by weight, with respect to the weight of (NCO) used.

The quantities of polyol and water are such that these reagents act on all the (NCO) groups present. In facts, an excess of water is generally used since this water has two functions: namely to participate in the reaction between the polyol and the isocyanate, by producing an emission of $CO_2$ and to participate in the foaming of the binder.

Of course, it is possible, as has been described in the processes for preparing polyurethane foams, to add various additives to the mixture such as catalysts (amine, non-ionic surface-active agents and silicon oils.

The following non-limiting example illustrates the invention. In this example, an isocyanate, a polyether and water have been used for stabilizing the binder foam.

The stabilized foam is obtained by using a hydrocarbon binder having a softening point (Ball Ring method) of the order of 50° C. to which is added about 3 percent by weight of an aromatic diisocyanate such as commercially available diphenylmethane diisocyanate. This mixture is foamed by injection of 2.25 percent by weight, with respect to said mixture, of a solution comprising two parts by weight of water for one part by weight of an aliphatic polyether obtained by condensation of ethylene oxide on an alcohol and comprising two free OH functions per molecule. This foaming takes place directly on the worksite, i.e. during the spreading of the hydrocarbon binder. The quantity of binder spread (0.5 to 3 kg of binder per square meter) is such that the foam formed has a thickness of the order of 15 mm. Less than 5 minutes after the spreading of the foam, chippings of grade 10/14 mm are then spread out. These chippings sink in the foam and the latter is destroyed by depositing the hydrocarbon binder on the coated surface and on the side faces of the chippings. If necessary, the small chippings of grade 2/6 mm are then spread, these chippings used in controlled quantities are inserted between the large chippings and are also stuck together and to the large chippings by the hydrocarbon binder. In this way, the large and small chippings adhere to the surface to be coated, and also their sides adhere to one another.

Of course, the coating thus made is, after the small chippings are spread, compacted by conventional processes.

The surface coating made in accordance with the above-described technique will be able to resist with greater efficacy the tangential tearing forces produced by vehicular traffic. This coating will, in addition, have certain advantages over previously employed techniques, particularly in the area of initial fragility since surface binders which are not fluxed may be used to make the coating achieved by the method of this invention.

I claim:

1. In a method for making road surface coatings from an asphalt binder and chippings mixed therewith, followed by compaction, the improvement wherein the asphalt binder is foamed utilizing a fluorinated hydrocarbon as an expansion agent and is in the form of a foam when the chippings are spread out and the thickness of said foam during such operation is substantially equal to the maximum dimension of the chippings.

2. The method of claim 1 wherein said chippings are spread out by double surfacing utilizing an initial spreading of coarse grade chippings, followed by a layer of fine grade chippings and said asphalt binder is in the form of a foam when said coarse grade chippings are spread out.

3. The method of claim 1 wherein said fluorinated hydrocarbon is $CC1_3F$.

4. The method of claim 1 wherein the foam of asphalt binder is maintained in expanded form for the order of 6.3 to 40 seconds after said foam has been applied.

* * * * *